US005718067A

United States Patent [19]

Ostinet et al.

[11] Patent Number: 5,718,067

[45] Date of Patent: Feb. 17, 1998

[54] SKI BOOT

[75] Inventors: Roberto Ostinet, Vittorio Veneto; Mario Mattiuzzo, Treviso, both of Italy

[73] Assignee: Lange International S.A., Switzerland

[21] Appl. No.: 810,063

[22] Filed: Mar. 3, 1997

Related U.S. Application Data

[63] Continuation of Ser. No. 509,108, Aug. 1, 1995, abandoned.

[30] Foreign Application Priority Data

Aug. 30, 1994 [CH] Switzerland ..... 2 5127/94

[51] Int. Cl.[6] ..... A43B 5/04

[52] U.S. Cl. ..... 36/117.1; 36/50.5; 36/89

[58] Field of Search ..... 36/50.5, 89, 117.1, 36/117.6, 117.8, 118.2

[56] References Cited

U.S. PATENT DOCUMENTS

| | | | |
|---|---|---|---|
| 2,660,812 | 12/1953 | Henke | 36/117 |
| 4,184,273 | 1/1980 | Boyer et al. | 36/117 |
| 4,381,613 | 5/1983 | Lederer | 36/121 |
| 4,665,635 | 5/1987 | Benoit et al. | 36/117 |
| 4,788,780 | 12/1988 | Boggs | 36/117 |
| 5,193,294 | 3/1993 | Pozzobon et al. | 36/120 |
| 5,297,350 | 3/1994 | Stampacchia et al. | 36/117 |
| 5,435,080 | 7/1995 | Meiselman | 36/117 |

FOREIGN PATENT DOCUMENTS

| | | | |
|---|---|---|---|
| 180011 | 10/1952 | Austria | 36/117 |
| 346458 | 6/1960 | Austria | 36/117 |
| 0358 599 A1 | 3/1980 | European Pat. Off. . | |
| 0 371 915 A1 | 6/1990 | European Pat. Off. . | |
| 0 379 836 A1 | 8/1990 | European Pat. Off. . | |
| 0380444 | 8/1990 | European Pat. Off. | 36/117 |
| 0442436 | 8/1991 | European Pat. Off. . | |
| 0470539 | 2/1992 | European Pat. Off. . | |
| 2345960 | 10/1977 | France . | |
| 2670654 | 6/1992 | France . | |
| 916696 | 7/1954 | Germany | 36/117 |
| 214531 | 4/1941 | Switzerland | 36/117 |

OTHER PUBLICATIONS

International Search Report of Counterpart Swiss application No. 2648/94.

*Primary Examiner*—M. D. Patterson

*Attorney, Agent, or Firm*—Kane, Dalsimer, Sullivan, Kurucz, Levy, Eisele and Richard, LLP

[57] ABSTRACT

The ski boot essentially consists of a lower part (1), in the form of a shell with a variable volume, and a boot leg, in the form of a collar (2). The collar (2) is articulated on the shell. The shell has two tightening buckles (4, 5) and the collar (2) has a closure and tightening buckle (6) located just below its upper end. The collar (2) has a lower-leg belt (10) surrounding the shell above the point of articulation (3) of the collar (2) on the shell. The lower-leg belt (10) has a closure and tightening buckle (11). When buckle (11) is closed and tightened, the buckle's tightening direction (F) passes above the point of articulation (3) in a slightly inclined direction towards the rear of the boot. The lower-leg belt (10) may consist of a material which is stiffer than the collar (2). The lower-leg belt (10) improves how the ski boot holds the lower leg without having to increase the apparent stiffness of the collar and without reducing the possibility of forward flexing of the collar by the lower leg.

6 Claims, 1 Drawing Sheet

SKI BOOT

This application is a continuation of application Ser. No. 08/509,108, filed Aug. 1, 1995, now abandoned.

FIELD OF THE INVENTION

The subject matter of the invention is a ski boot, essentially consisting of a lower part in the form of a shell with variable volume, surrounding the foot and the heel, and of a boot leg in the form of a collar which is articulated on the shell, the shell and collar being provided with a closure and tightening means.

PRIOR ART

This well-known type of boot is described, for example, in Patents EP 0,358,599, EP 0,371,915 and EP 0,379,836.

During skiing, the boot acts as a sort of interface between the ski and the leg of the skier. In order for the reaction of the ski on the surface of the snow to be transmitted immediately and accurately to the leg and, conversely, for the control exerted by the skier on the ski via the leg and the interface also to be transmitted immediately and accurately, the foot and the lower leg must be held perfectly by the boot, the sole of which is rigidly connected to the ski by the binding. The ideal case would, of course, be for the boot to be integral with the foot and the lower leg. The boot leg would then have to satisfy two incompatible requirements, namely, on the one hand, high stiffness so as to transmit as well as possible the forces exerted by the leg to the ski, and vice versa, and, on the other hand, sufficient flexibility for it to be opened, in order to allow the boot to be put on and taken off, and for it to be closed and tightened around the leg, as well as to allow flexing of the leg. For collars generally produced in a single piece, it has been necessary to adopt a compromise in order to satisfy these two requirements, this being at the cost of accuracy in controlling the skis.

In competition, this accuracy was quickly judged to be unsatisfactory, and means were sought to improve it. Thus, a boot was proposed in 1980 under the brand name MUNARI, the collar of which is produced in three parts, namely a front tongue which also extends over the shell, a lower half-collar articulated on the shell, and an upper half-collar surrounding the lower leg and connected at the rear to the lower half-collar. The lower half-collar is provided with a buckle which passes over the instep and provides diagonal tightening toward the heel. Producing the collar in three parts makes it possible to have parts with different stiffness, it being possible for the lower collar to be stiffer than the upper collar, without excessively hindering opening of the boot leg for putting the boot on and taking it off. The position of the buckle of the lower half-collar, arranged so as to provide diagonal tightening of the boot along a diagonal passing through the instep and the heel, is such that, when the leg flexes, the lower half-collar presses immediately on the shell and, through the effect of the flexing which nevertheless continues, this pressure on the shell, just below the instep, has the effect of causing transverse expansion of the shell, reducing the degree of holding of the foot and consequently control of the ski.

It should be pointed out here that diagonal tightening of the heel has become a myth which seems to have originated with the appearance of so-called rear-entry boots which include a fixed-volume shell in which the foot is held by internal diagonal tightening using a shaped part which bears on the instep and is pulled in the direction of the heel by a cable. This myth is such that the purchaser of a pair of ski boots, when trying on a pair of boots, tries to lift the heel in order to check holding of the foot. However, highly localized tightening of the heel is irrelevant to the modern skiing technique, for which tightening which is distributed well around the foot proves preferable.

A boot from 1983 is moreover known, under the brand name DOLOMITE, the boot leg of which consists of a collar surrounding the front of the leg substantially above the instep, and the variable-volume shell of which is provided with a belt which passes, on the one hand, over the instep and, on the other hand, to the rear of the shell above the heel and under the shell. This belt makes it possible to obtain good diagonal tightening of the shell in the direction of the heel, but its low position does not contribute to support of the lower leg. Furthermore, the articulation of the collar is offset upward, so that it no longer corresponds at all to the natural articulation of the leg at the malleoli.

SUMMARY OF THE INVENTION

The object of the present invention is to improve support of the lower leg by the collar constituting the boot leg, without it being necessary to increase the apparent stiffness of the collar, that is to say the stiffness which the user may observe when putting the boot on and taking it off, and without the possibility of forward flexing being reduced relative to a conventional collar, and without the expansion phenomenon being enhanced.

In the ski boot according to the invention, the collar comprises a lower-leg belt surrounding the shell above the articulation of the collar on the shell and provided with a closure and tightening buckle, the tightening direction of which passes above said articulation.

This belt surrounds and therefore tightens the lower leg approximately at the same height as the lower buckle of a traditional collar, and preferably slightly lower, and presses the foot against the sole.

The belt may consist of an additional part and, in order to hold it, the pins for articulation of the boot leg on the shell preferably pass through it, but it could be held in place by other means.

The belt could consist of a part of the collar, in particular the lower part of the collar, in an embodiment of the collar in two materials having different stiffness, obtained by a double injection process.

In addition, the tightening direction of the buckle of the belt is preferably slightly inclined toward the rear, so that the tightening force has a component in the direction of the sole. This component acts with a reaction component due to the surrounding shape of the rear of the shell, these two components contributing to pressing the heel against the sole of the boot.

BRIEF DESCRIPTION OF THE DRAWINGS

The attached drawing represents, by way of example, one embodiment of the invention.

DESCRIPTION OF THE PREFERRED EMBODIMENT

Figure 1:
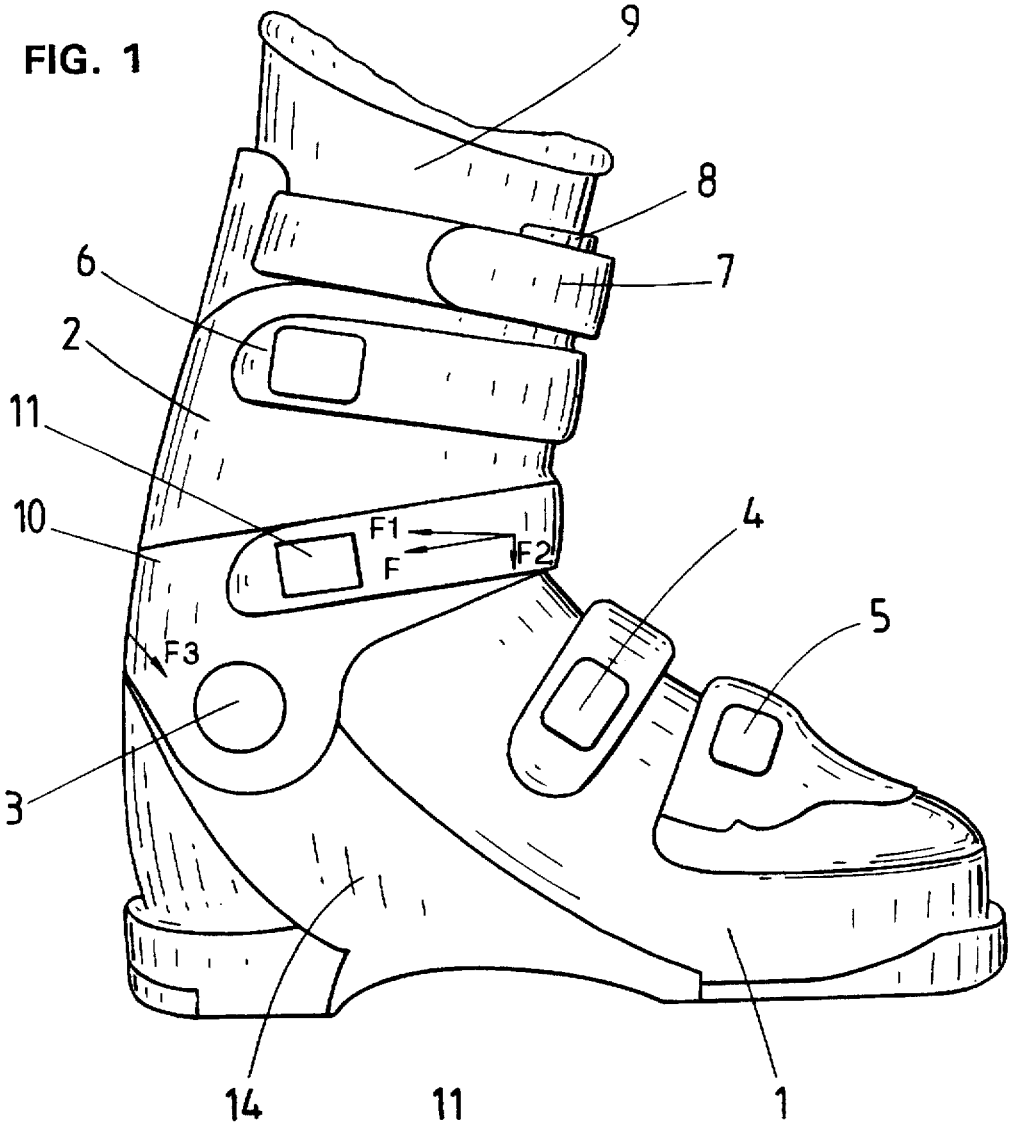
FIG. 1 represents a boot in the closed position, seen from the outer side of the foot.

The boot represented comprises a shell 1 with variable volume, comprising the sole and surrounding the foot and the heel, on which shell a boot leg consisting of a collar 2 which is articulated on the shell 1 in a known manner at two points located approximately at the height of the malleoli is mounted, one of these articulations 3 being visible on the drawing. This articulation consists of a metal pin consisting, for example, of a rivet. The shell 1 is provided with two tightening buckles 4 and 5, the buckle 5 having, in this case, a particular shape defining an extension projecting forward. The collar 2 is provided with a closure and tightening buckle 6 located just below its upper end, which is furthermore provided with a strap 7 which has a conventional closure such as a VELCRO (registered trademark) closure, which bears at the front on a tongue 8 of a comfort inner boot 9 in order to support the tibia in a known fashion.

The boot is furthermore provided with a belt 10 surrounding the collar 2 just above its articulation 3 on the shell; the belt 10 therefore also surrounds the shell. In the example represented, the belt 10 extends in a zone located approximately 4 cm above the center of the articulation 3. This belt 10 is provided with a closure and tightening buckle 11 similar to the buckle 6, the tightening direction of which passes above the articulation 3. The tightening direction is slightly inclined toward the rear. In the example represented, this inclination is approximately 8°. It is preferably between 5° and 15°. The articulations 3 pass through the belt 10 and the latter is therefore held on the shell 1 and the collar 2 by these articulations.

Figure 2:
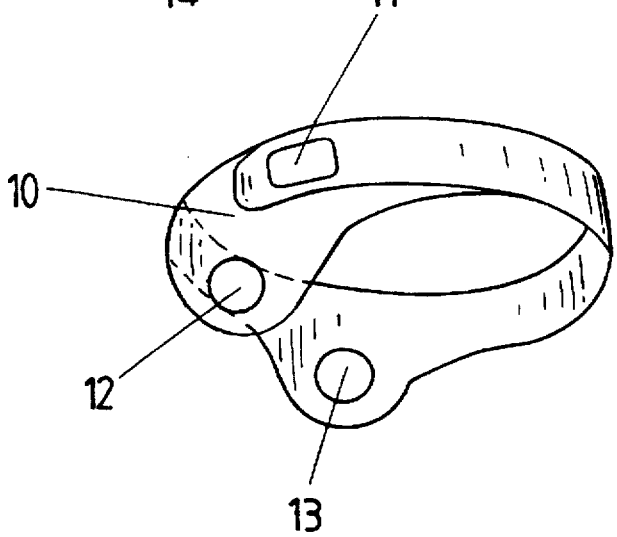
FIG. 2 represents the lower-leg belt.

The belt 10 is represented in isolation in FIG. 2. This figure shows that it is provided with two circular holes 12 and 13 for passage of the articulations of the collar 2 onto the shell 1.

The belt 10 exerts a tightening force on the front of the leg, with a force F which is slightly inclined toward the rear with an inclination of approximately 8°. This force decomposes into a force F1 transverse to the collar and a force F2 directed toward the sole. Because of the surrounding shape of the rear of the shell, the tightening force generates a reaction having a component F3 directed obliquely toward the sole. The components F2 and F3 tend to press the heel against the sole. The belt 10 therefore fully satisfies its function of improving support of the lower leg, while contributing to perfectly satisfactory support of the heel in the boot.

The belt 10 could have an inclination other than the inclination represented. This inclination will preferably be between 5° and 15°. The belt 10 could, however, be horizontal and still fulfil its function of supporting the lower leg.

It is not absolutely necessary for the articulations of the collar on the shell to pass through the lower-leg belt. In fact, the belt could be retained vertically on the collar 2 by other means, for example at the rear by a rivet or a lug or laterally by a groove or stops.

The lower-leg belt could be used in combination with a reinforcing band 14 passing through the articulations of the collar, under the belt 10, behind the shell and extending obliquely toward the front on each side of the shell, in the direction of the sole. Such a band 14, made of a rigid plastic, opposes the expansion of the shell caused by the pressure of the collar 2 on the shell when the leg flexes. Such a band is described in Patent EP 0,380,444 in the name of the Applicant.

As indicated hereinabove, the belt could be a part of the collar in a two-material embodiment. In such a case, the belt will advantageously constitute the entire lower part of the collar, which surrounds the upper part of the shell and through which the pins for articulating the collar on the shell pass.

We claim:

1. A ski boot for a skier having a foot, heel and lower leg having a front, essentially consisting of a lower part shell (1) with variable volume surrounding a foot and a heel, the shell having a sole and a front and a rear, and of a boot leg collar (2) which is articulated on the shell by articulation means (3), the shell and collar being provided with a closure and tightening means (4,5,6) a lower-leg belt 10 entirely surrounding said collar above the articulation means (3) of the boot leg collar on the shell and provided with a closure and tightening buckle (11) which when tightened, exerts tightening forces on the front of the lower leg and has a tightening direction (F) which passes above said articulation means and is slightly inclined toward the rear and which has a component (F2) in the direction of the sole, the tightening forces generating reaction forces having a component (F3) at the rear of the shell directed obliquely toward the sole, and the components (F2) and (F3) pressing the foot and heel against the sole of the shell whereby the ski boot improves the support of the lower leg without increasing the stiffness of the collar and without reducing the possibility of forward flexing of the collar relative to the shell about the articulation means.

2. The ski boot as claimed in claim 1, wherein the belt (10) is an additional part surrounding the collar (2).

3. The ski boot as claimed in claim 2, wherein the articulation means of the collar on the shell are pins (3) which pass through said belt (10) and consequently retain the latter.

4. The ski boot as claimed in claim 1, wherein the lower-leg belt is a part of the collar made of two materials having different stiffnesses.

5. The ski boot as claimed in claim 1, wherein the tightening direction (F) of the buckle of the belt has an inclination toward the rear of between 5° and 15°.

6. The ski boot as claimed in claim 1, wherein the shell (1) is furthermore fitted with an antiexpansion reinforcement band (14) passing through the articulation means of the collar, below the belt (10) to the rear of the shell and extending obliquely forward, on each side of the shell, toward the sole.

* * * * *

UNITED STATES PATENT AND TRADEMARK OFFICE

CERTIFICATE OF CORRECTION

PATENT NO. : 5,718,067

DATED : February 17, 1998

INVENTOR(S) : Ostinet et al.

It is certified that error appears in the above-identified patent and that said Letters Patent is hereby corrected as shown below:

Title page:

Item [30] reads

"Aug. 30, 1994 [CH] Switzerland 2 5127/94"

SHOULD READ

--Aug. 30, 1994 [CH] Switzerland 2 648/94-9--

Signed and Sealed this

Second Day of June, 1998

*Attest:*

*Attesting Officer*

Bruce Lehman

BRUCE LEHMAN

*Commissioner of Patents and Trademarks*